US008852725B2

(12) United States Patent
Sachs et al.

(10) Patent No.: US 8,852,725 B2
(45) Date of Patent: Oct. 7, 2014

(54) VESSEL CLOSING LAMINATE

(75) Inventors: Victor Sachs, Sanderstead (GB); David John O'Brien, Oxney (GB); Andrew Fenwick McLean, Reading (GB)

(73) Assignee: Selig Sealing Products, Inc., Forrest, IL (US)

( * ) Notice: Subject to any disclaimer, the term of this patent is extended or adjusted under 35 U.S.C. 154(b) by 66 days.

(21) Appl. No.: 13/348,842

(22) Filed: Jan. 12, 2012

(65) Prior Publication Data

US 2012/0107577 A1 May 3, 2012

Related U.S. Application Data

(63) Continuation of application No. 12/227,573, filed as application No. PCT/US2007/006595 on Mar. 16, 2007, now abandoned.

(30) Foreign Application Priority Data

Mar. 20, 2006 (EP) ..... 06111411

(51) Int. Cl.

| | |
|---|---|
| ***B41M 5/00*** | (2006.01) |
| ***B32B 9/00*** | (2006.01) |
| ***B32B 27/00*** | (2006.01) |
| ***B65D 39/00*** | (2006.01) |
| ***B65D 51/00*** | (2006.01) |
| ***B65D 53/00*** | (2006.01) |
| ***B32B 37/00*** | (2006.01) |
| ***B65D 51/20*** | (2006.01) |
| ***B65D 53/04*** | (2006.01) |

(52) U.S. Cl.

CPC ..... *B65D 51/20* (2013.01); *B65D 2251/0015* (2013.01); *B65D 53/04* (2013.01); *B65D 2251/0093* (2013.01)

USPC ..... 428/195.1; 428/318.4; 428/319.3; 215/232; 215/347; 156/182; 156/364

(58) Field of Classification Search

CPC ..... B65D 51/20; B65D 53/04; B65D 2251/0093; B65D 2251/0015

USPC ..... 428/195.1, 318.4, 319.3; 215/232, 347; 156/182, 364

See application file for complete search history.

(56) References Cited

U.S. PATENT DOCUMENTS

| | | | |
|---|---|---|---|
| 4,206,165 | A | 6/1980 | Dukess |
| 4,741,791 | A | 5/1988 | Howard et al. |

(Continued)

FOREIGN PATENT DOCUMENTS

| | | | |
|---|---|---|---|
| AT | 501 393 | A1 | 8/2006 |
| AT | 11 738 | U1 | 4/2011 |

(Continued)

OTHER PUBLICATIONS

Japanese Patent Office Notification of Reasons for Refusal dated Jan. 31, 2012 for Japanese Patent Application No. 2009-501463 with English Translation, 7 pages.

(Continued)

*Primary Examiner* — Jeremy R Pierce

(74) *Attorney, Agent, or Firm* — Fitch, Even, Tabin & Flannery LLP

(57) ABSTRACT

A vessel closing laminate comprising: a seal laminate comprising a bottom subassembly of layers including a foil layer; and a seal substrate attached to the uppermost layer of the bottom subassembly of layers wherein the seal substrate has a bottom foam layer and a top plastic material layer and further includes a free tab lying wholly within the circumference of the seal; a wax layer on top of the plastic material layer of the seal substrate; and an absorbent liner adhered to the plastic material layer of the seal substrate by means of the wax layer.

25 Claims, 3 Drawing Sheets

(56) References Cited

U.S. PATENT DOCUMENTS

| | | | |
|---|---|---|---|
| 4,772,650 | A | 9/1988 | Ou-Yang |
| 4,818,577 | A | 4/1989 | Ou-Yang |
| 4,837,061 | A | 6/1989 | Smits et al. |
| 4,961,986 | A | 10/1990 | Galda et al. |
| 5,015,318 | A | 5/1991 | Smits et al. |
| 5,055,150 | A | 10/1991 | Rosenfeld et al. |
| 5,057,365 | A | 10/1991 | Finkelstein et al. |
| 5,071,710 | A | 12/1991 | Smits et al. |
| 5,098,495 | A | 3/1992 | Smits et al. |
| 5,149,386 | A | 9/1992 | Smits et al. |
| 5,178,967 | A | 1/1993 | Rosenfeld et al. |
| 5,197,618 | A | 3/1993 | Goth |
| 5,381,913 | A | 1/1995 | Peeters |
| 5,381,914 | A | 1/1995 | Koyama et al. |
| 5,598,940 | A | 2/1997 | Finkelstein et al. |
| 5,601,200 | A | 2/1997 | Finkelstein et al. |
| 5,615,789 | A | 4/1997 | Finkelstein et al. |
| 5,669,521 | A | 9/1997 | Wiening et al. |
| 5,702,015 | A | 12/1997 | Giles et al. |
| 5,712,042 | A | 1/1998 | Cain |
| 5,871,112 | A | 2/1999 | Giles et al. |
| 6,082,566 | A | 7/2000 | Yousif et al. |
| 6,131,754 | A | 10/2000 | Smelko |
| 6,139,931 | A | 10/2000 | Finkelstein et al. |
| 6,194,042 | B1 | 2/2001 | Finkelstein et al. |
| 6,277,478 | B1 | 8/2001 | Kurita et al. |
| 6,312,776 | B1 | 11/2001 | Finkelstein et al. |
| 6,378,715 | B1 | 4/2002 | Finkelstein et al. |
| 6,458,302 | B1 | 10/2002 | Shifflet |
| 6,602,309 | B2 | 8/2003 | Vizulis et al. |
| 6,699,566 | B2 | 3/2004 | Zeiter et al. |
| 6,705,467 | B1 | 3/2004 | Kancsar et al. |
| 6,722,272 | B2 | 4/2004 | Jud |
| 6,767,425 | B2 | 7/2004 | Meier |
| 6,902,075 | B2 | 6/2005 | O'Brien et al. |
| 6,916,516 | B1 | 7/2005 | Gerber et al. |
| 6,955,736 | B2 | 10/2005 | Rosenberger et al. |
| 6,974,045 | B1 | 12/2005 | Trombach et al. |
| 7,128,210 | B2 | 10/2006 | Razeti et al. |
| 7,182,475 | B2 | 2/2007 | Kramer et al. |
| RE39,790 | E | 8/2007 | Fuchs et al. |
| 7,316,760 | B2 | 1/2008 | Nageli |
| 7,448,153 | B2 | 11/2008 | Maliner et al. |
| 7,531,228 | B2 | 5/2009 | Perre et al. |
| 7,713,605 | B2 | 5/2010 | Yousif et al. |
| 7,740,927 | B2 | 6/2010 | Yousif et al. |
| 7,819,266 | B2 | 10/2010 | Ross et al. |
| 7,838,109 | B2 | 11/2010 | Declerck |
| 8,329,288 | B2 | 12/2012 | Allegaert et al. |
| 2002/0068140 | A1 | 6/2002 | Finkelstein et al. |
| 2003/0196418 | A1 | 10/2003 | O'Brien et al. |
| 2004/0109963 | A1 | 6/2004 | Zaggia et al. |
| 2004/0247749 | A1* | 12/2004 | Lambert et al. ..... 426/107 |
| 2005/0048307 | A1 | 3/2005 | Schubert et al. |
| 2006/0000545 | A1 | 1/2006 | Nageli et al. |
| 2006/0003120 | A1 | 1/2006 | Nageli et al. |
| 2006/0003122 | A1 | 1/2006 | Nageli et al. |
| 2006/0151415 | A1 | 7/2006 | Smelko et al. |
| 2007/0003725 | A1* | 1/2007 | Yousif ..... 428/195.1 |
| 2007/0298273 | A1 | 12/2007 | Thies et al. |
| 2008/0026171 | A1 | 1/2008 | Gullick et al. |
| 2008/0103262 | A1 | 5/2008 | Haschke |
| 2008/0156443 | A1 | 7/2008 | Schaefer et al. |
| 2009/0078671 | A1 | 3/2009 | Triquet et al. |
| 2009/0208729 | A1 | 8/2009 | Allegaert et al. |
| 2010/0009162 | A1 | 1/2010 | Rothweiler |
| 2010/0030180 | A1 | 2/2010 | Declerck |
| 2010/0059942 | A1 | 3/2010 | Rothweiler |
| 2010/0116410 | A1 | 5/2010 | Yousif |
| 2010/0155288 | A1 | 6/2010 | Harper et al. |
| 2010/0170820 | A1 | 7/2010 | Leplatois et al. |
| 2010/0213193 | A1 | 8/2010 | Helmlinger et al. |
| 2010/0221483 | A1 | 9/2010 | Gonzalez Carro et al. |
| 2010/0290663 | A1 | 11/2010 | Trassl et al. |
| 2010/0314278 | A1 | 12/2010 | Fonteyne et al. |
| 2011/0000917 | A1 | 1/2011 | Wolters et al. |
| 2011/0005961 | A1 | 1/2011 | Leplatois et al. |
| 2011/0091715 | A1 | 4/2011 | Rakutt et al. |

FOREIGN PATENT DOCUMENTS

| | | | |
|---|---|---|---|
| BR | 8200231 | U | 9/2003 |
| BR | 0300992 | A | 11/2004 |
| CN | 2279333 | Y | 4/1998 |
| DE | 91 08 868.2 | U1 | 10/1991 |
| DE | 102 04 281 | A1 | 8/2003 |
| DE | 10 2006 030 118 | B3 | 5/2007 |
| DE | 10 2007 022 935 | B4 | 4/2009 |
| DE | 20 2009 000 245 | U1 | 4/2009 |
| EP | 0 668 221 | A1 | 8/1995 |
| EP | 0 826 598 | A2 | 3/1998 |
| EP | 0 826 599 | A2 | 3/1998 |
| EP | 0 717 710 | B1 | 4/1999 |
| EP | 0 915 026 | A1 | 5/1999 |
| EP | 0 706 473 | A1 | 8/1999 |
| EP | 1 181 217 | B1 | 9/2003 |
| EP | 0 803 445 | B1 | 11/2003 |
| EP | 1 834 893 | A1 | 9/2007 |
| EP | 1 839 898 | A1 | 10/2007 |
| EP | 1 839 899 | A1 | 10/2007 |
| EP | 1 857 275 | A1 | 11/2007 |
| EP | 1 873 078 | A1 | 1/2008 |
| EP | 1 918 094 | A1 | 5/2008 |
| EP | 1 472 153 | B1 | 6/2008 |
| EP | 1 968 020 | A1 | 9/2008 |
| EP | 1 992 476 | A1 | 11/2008 |
| EP | 2 230 190 | A1 | 9/2010 |
| EP | 2 292 524 | A1 | 3/2011 |
| EP | 1814744 | A1 | 8/2012 |
| FR | 2 916 157 | A1 | 11/2008 |
| FR | 2 943 322 | A1 | 9/2010 |
| JP | H04-239456 | A | 8/1992 |
| JP | H06-166151 | A | 6/1994 |
| JP | 2000-255621 | A | 9/2000 |
| JP | 2003-037310 | A | 2/2002 |
| JP | 2003-165566 | A | 6/2003 |
| JP | 2003-312730 | A | 11/2003 |
| JP | 2004-315035 | A | 11/2004 |
| JP | 2006-069601 | A | 3/2006 |
| KR | 10-0711073 | B1 | 4/2007 |
| KR | 10-0840926 | B1 | 6/2008 |
| KR | 10-0886955 | B1 | 3/2009 |
| MX | PA05002905 | A | 2/2006 |
| MX | 2010001867 | A | 4/2010 |
| TW | 194965 | | 11/1992 |
| WO | 96/05055 | A1 | 2/1996 |
| WO | 00/66450 | A1 | 11/2000 |
| WO | 2006/018556 | A1 | 2/2006 |
| WO | 2006/021291 | A1 | 3/2006 |
| WO | 2006/099260 | A1 | 9/2006 |
| WO | 2006/108853 | A1 | 10/2006 |
| WO | 2007/109113 | A2 | 9/2007 |
| WO | 2008/027029 | A2 | 3/2008 |
| WO | 2008/027036 | A1 | 3/2008 |
| WO | 2008/039350 | A2 | 4/2008 |
| WO | 2008/125784 | A1 | 10/2008 |
| WO | 2008/125785 | A1 | 10/2008 |
| WO | 2008/148176 | A1 | 12/2008 |
| WO | 2010/115811 | A1 | 10/2010 |
| WO | 2011/039067 | A1 | 4/2011 |

OTHER PUBLICATIONS

Opposition to European Patent 1 837 288 B1 by Alfelder Kunststoffwerke Herm. Meyer GmbH, Reply to the Notice of Opposition filed on Jul. 28, 2010 by the Proprietor, 7 pages.

Opposition to European Patent 1 837 288 B1 by Alfelder Kunststoffwerke Herm. Meyer GmbH, Summons to Attend Oral Proceedings pursuant to Rule 115(1) EPC dated Oct. 4, 2011, 12 pages.

Opposition to European Patent 1 837 288 B1 by Alfelder Kunststoffwerke Herm. Meyer GmbH, Written Submissions in preparation for the Oral Proceedings filed on Nov. 16, 2011 by the Opponent, 5 pages.

(56) References Cited

OTHER PUBLICATIONS

Opposition to European Patent 1 837 288 B1 by Alfelder Kunststoffwerke Herm. Meyer GmbH, Summons to Attend Oral Proceedings pursuant to Rule 115(1) EPC dated Dec. 13, 2011, 12 pages.
Opposition to European Patent 1 837 288 B1 by Alfelder Kunststoffwerke Herm. Meyer GmbH, Submission under the provisions of Rule 116 EPC in preparation for the Oral Proceedings filed on Mar. 23, 2012 by the Proprietor, 17 pages.
Opposition to European Patent 1 837 288 B1 by Alfelder Kunststoffwerke Herm. Meyer GmbH, Information concerning the result of the Oral Proceedings dated Apr. 24, 2012, 9 pages.
Opposition to European Patent 1 837 288 B1 by Alfelder Kunststoffwerke Herm. Meyer GmbH, Minutes of the Oral Proceedings dated May 21, 2012, 43 pages.
Opposition to European Patent 1 837 288 B1 by Alfelder Kunststoffwerke Herm. Meyer GmbH, Notice of Appeal filed on Jul. 24, 2012 by the Proprietor, 4 pages.
Opposition to European Patent 1 837 288 B1 by Alfelder Kunststoffwerke Herm. Meyer GmbH, Statement of Grounds of Appeal filed on Oct. 1, 2012 by the Proprietor, 22 pages.
European Patent Office Extended European Search Report for European Application 06111411.2 dated Aug. 29, 2006 (6 pages).
International Searching Authority Notification of Transmittal of the International Search Report and the Written Opinion for International Application PCT/US2007/006595 dated Aug. 21, 2009 (8 pages).
The International Bureau of WIPO International Preliminary Report on Patentability for International Application PCT/US2007/006595 dated Sep. 8, 2009 (4 pages).
European Patent Office Communication of a Notice of Opposition to European Patent 1 837 288 B1 by Alfelder Kunststoffwerke Herm. Meyer GmbH dated Feb. 25, 2010 (20 pages), with English translation (12 pages).
Selig, "Your Technical Guide to Successful Sealing," 2011 Edition, www.seligsealing.com, pp. 1-60.
Opposition to European Patent 1 837 288 B1 by Alfelder Kunststoffwerke Herm. Meyer GmbH, Communication to the European Patent Office dated Feb. 19, 2013 (with translation), 24 pages.

* cited by examiner

VESSEL CLOSING LAMINATE

CROSS-REFERENCE TO RELATED APPLICATIONS

This application is a continuation of prior application Ser. No. 12/227,573, filed Nov. 20, 2008, which is abandoned, and which is a U.S. national phase application filed under 35 U.S.C. §371 of International Application PCT/US2007/006595, filed Mar. 16, 2007, designating the United States, which claims priority from European Patent Application Number EP 06111411.2, filed Mar. 20, 2006, which are all hereby incorporated herein by reference in their entirety.

FIELD

The present invention relates to a vessel closing laminate.

BACKGROUND

It is commonplace in the packaging of a wide variety of materials ranging from pharmaceutical products to instant coffee that a closure is provided in the form of a seal connected to the neck of a container and a screw cap covering and protecting the seal which provides a re-closable cap after the seal has been removed to gain access to the container. Often the closure is such that the underside of the seal has a heat sensitive adhesive coating or a meltable plastics layer covered by a metal foil. The metal foil can provide the substrate of the seal or may include a separate substrate formed from plastics material or paper. The seal is then placed against the neck of a container and sandwiched against it by the applied screw cap. An induction heating step then heats the metal foil and in turn activates the heat sensitive adhesive layer or melts the plastic layer so that on cooling, the seal bonds to the neck of the container. A difficulty often encountered by eventual users is removal of such seals from the container. Attempts have thus been made to include a tab extending sideways from the neck of the container so that the consumer can grip this to facilitate removal of the seal.

One way of overcoming this, which is proving popular at present, is the so-called "Top Tab" (Registered trademark) system, which is described fully in U.S. Pat. No. 4,961,986. This system includes a multilayer substrate which is partly de-laminated to provide a lifting tab lying wholly within the circumference of the container neck. In U.S. Pat. No. 4,961,986 this is achieved by forming the substrate from multiple layers which are adhered together over only a part of their extent. U.S. Pat. No. 5,702,015 also discloses such a seal but, in this case, the seal substrate is formed by an extrusion process in which a first layer of plastics material is extruded, followed by extrusion lamination of a second layer of release material using a third layer of extrusion material which is of the same composition to that of the first layer which integrates with the first layer where the second layer is not present. In this way the tab, which is formed by the third layer, is formed integrally with the first layer without the need for adhesive between the layers.

As shown in U.S. Pat. No. 4,961,986 the screw-cap may include some form of liner in addition to the seal material. A difficulty with a two-component system is that the seal material and the liner which are provided separately, have to be fitted inside a screw-cap in two separate operations. This naturally adds to the expense and difficulty of using the system.

In order to minimize the processing steps included in producing a seal and liner system, there has been focus on the development of a one component seal and liner system which avoids the need for two separate fitting operations.

In this regard, EP-A-1472153 describes a one component seal and liner system, for attaching into a screw cap, which includes a tab. In the product detailed, the seal portion of the system is adhered to the liner portion by means of a release layer such that the seal and liner release from each other with a peel strength in the range from 20 to 90 g at a rate of 1500 mm/min on a sample strip 25 mm wide. The adhesive used is low density polyethylene. One disadvantage of such a system is that, when fixed in a screw cap, in order that release occurs as required, it is often the case that the system needs to be rotatable within the cap rather than fixed in place. This means that screw caps which have a circumferentially extending rib are required thus increasing the costs of the overall process.

A further example of a one component seal and liner system is DE9108866 in which the seal and liner portions are adhered by means of wax for the purposes of handling and fitting the system. On heating of the metal foil in the seal portion the wax melts and is absorbed into an absorbent secondary liner whereby the seal portion and liner substantially separate from each other. On opening the seal portion remains adhered to the container and the liner remains in the cap. This system includes a tab which is formed by adhering the top layer of seal portion to the remainder of the seat across part only of the area of the seal.

A problem with this system is that the seal portion has a tendency to tear in use when a user attempts to remove the seal from a container to which it is attached by pulling on the tab.

A further problem which can be identified with such systems is that in attaching the system including the tab to a container to be sealed, an uneven level of bonding is achieved with there being a propensity for higher bonds to be formed under the tabbed portion of the liner as compared to the non-tabbed portion. There is a further danger that on heating the metal foil, the top layer of the seal will burn where the heat transferred to this layer is too great.

In WO-A-9605055 multilayer composite films having a barrier layer of amorphous carbon between a heat sealable layer and a polymeric base layer are described. The laminate may be used as part of an induction innerseal for a screw-capped container, for instance a system including an absorbent liner adhered to the top of the composite film by means of a wax layer. Upon induction heating the wax melts and is absorbed into the liner to release the adhesion of the liner. Another use of the laminates is to form top-tabbed innerseals, i.e. vessel closing assemblies including a free tab lying wholly within the circumference of the seal.

It is clear that there is a need for a vessel closing assembly which is economical to use but avoids the problems associated with the prior art.

SUMMARY

The present invention provides a vessel closing laminate comprising:

a seal laminate comprising a bottom subassembly of layers including a bottom food contact layer and a foil layer; and a seal substrate attached to the uppermost layer of the bottom subassembly of layers wherein the seal substrate has a bottom foam layer and a top plastics material layer and further includes a free tab lying wholly within the circumference of the seal;

a wax layer on top of the plastics material layer of the seal substrate, and an absorbent liner adhered to the plastics material layer of the substrate by means of the wax layer.

By the combination of including a foam layer within the seal substrate and using a wax layer to adhere the seal substrate to the liner, the present invention overcomes the above disadvantage associated with the prior art, more specifically, the inclusion of the foam layer as an essential component of the seal substrate means that, in use when attached to a container to be sealed, when the user pulls on the tab to remove the seal, the seal substrate is resistant to tearing.

In one embodiment of the present invention, the bottom subassembly of layers are induction heat sealable and comprise a layer of aluminum foil coated on its lowermost face which will ultimately be in contact with the neck of a container with a layer of hot melt adhesive. A layer of polyester may be interposed between the hot melt adhesive and aluminum foil layer to isolate the foil from the contents of any container to which it is attached and so prevent corrosion of the foil layer and contamination of food. Where included, this polyethylene terephthalate layer generally has a thickness in the range from 10 to 14 μm. It is attached to the foil layer using either a solvent or solvent-less adhesive lamination. Where it is included, the polyethylene terephthalate has already been attached to the foil layer by the supplier. Preferably the thickness of the foil layer is in the range from 12-30 μm, more preferably 20-25 μm.

In a further embodiment of the present invention the bottom subassembly of layers of the seal laminate are conduction heat sealable.

In a yet further embodiment of the present invention, the bottom subassembly of layers of the seal comprise a layer of metal foil coated on its lowermost face which will ultimately be in contact with the neck of a container with glassine. Glassine is a paper based material which is formed from pulp which has been beaten to the extent that its constituent fibres are all very short resulting in a brittle material which is almost transparent. Glassine is commercially available from, for example, Ahlstrom in France. The glassine is adhered to the lowermost face of the metal foil by a layer of adhesive. While conventionally in a system comprising glassine and foil adjacent to one another, a wax based adhesive would be used to adhere the glassine to the foil, it is preferable in the invention to use a polyethylene-based or a water-based adhesive in order to ensure a sufficiently strong bond is formed.

In use, the bottom glassine layer of the seal may be adhered to the neck of a container using a conventional adhesive such as, for example, polyvinyl acetate. In this embodiment, the thickness of the foil layer may be as low as 9 μm. In use, where the primary laminate is removed from a container neck, failure will occur in the glassine layer such that paper fibres remain adhered to the neck of the container but the primary laminate is still removed as a single piece. The advantage of the paper fibres remaining adhered to the neck is that it provides a tamper evident system.

The top layer of the bottom subassembly of layers is adhered to a seal substrate. The adhesion is by means of a polymer adhesive. Suitable adhesives include polyurethane.

The seal substrate has a bottom foam layer. Preferably the foam layer has a thickness in the range from 70 to 300 μm. The foam layer is preferably a foamed polyolefin; for example, polyethylene. The foam layer is included in the structure to impart structural integrity. The inclusion of this foam layer means that the problems associated with the prior art are overcome. More specifically, this foam layer has a cushioning effect such that the pressure exerted around the circumference of the laminate when it has been cut to form a vessel closing assembly which is adhered to the neck of the container, is equalized. Thus the difference in thickness of the non tabbed portion as compared to the tabbed portion, does not result in a difference in the strength of the bond formed. That is to say that a uniform bond strength between the laminate and neck of the container is obtained around the whole circumference. A further advantage is that in induction heat sealing to adhere a vessel closing assembly cut from the laminate of the present invention, the foam layer acts an insulating layer. This regulates the amount of heat which reaches the wax layer such that the wax layer is melted but the risk of burning the liner portion is minimized. As the foam layer imparts structural integrity to the laminate, it is possible to use thinner liner components than are routinely used. It is also to be noted that the inclusion of the foam layer is further advantageous when it comes to a consideration of the processing steps by which a vessel closing assembly cut from the laminate of the present invention is attached to a container to be sealed. A popular way of doing this is to use a vacuum process wherein the vessel closing assembly is picked up and placed in position by use of a vacuum. Where the prior art assemblies are subjected to such a process, there is a problem that the seal laminates folds in on itself under the force of the vacuum causing distortion and creasing. If such a seal is then adhered to a container to be sealed, it will have a tendency to leak because the circumference of the seal no longer corresponds directly to the circumference of the container to be sealed. This is a problem avoided with the present invention because the foam liner imparts sufficient structural integrity that the laminate will remain rigid and flat when subjected to a vacuum.

Where the bottom subassembly of layers comprise heat induction sealable layers, the inclusion of a foam layer ensures that any surface irregularities are minimized.

The seal substrate of the present invention includes a tab which lies wholly within the circumference of the seal. A tab is included to facilitate the eventual removal of the seal from a container to which it has been adhered. In its most simple embodiment, the tab may be produced by adhering the bottom foam layer and the top plastics material of the seal substrate to each other over only a portion of the diameter thus producing a partially delaminated structure. Structural integrity may be given to the tab by interposing a further layer of plastics material between the bottom foam layer and top plastics material layer of the seal substrate in the region in which they are not bonded and then adhering the further layer of plastics material to the top plastics material layer. Preferably the further layer of plastics material is adhered to the top plastics material by means of a polymeric adhesive. If required, the tab portion may also be printed. Where the tab is formed in this way, the final tab will be comprised of the further layer of interposed plastics material, a polymeric adhesive and the top plastics material layer. Such a tab has an overall thickness preferably in the range from 80 to 100 μm. Preferably the further layer of plastics material is polyester and the top plastic material layer is made from polyester or polyamide.

In one embodiment of the present invention, the seal portion of the vessel closing laminate is formed using an extrusion technique. Such a technique involves the steps of:

(a) feeding a seal laminate comprising the bottom subassembly of layers and the bottom foam layer of the seal substrate to a laminating station;

(b) feeding a tabstock which is narrower than the seal laminate to the laminating station such that the bottom of the tabstock and the top foam layer of the seal laminate come into contact to form a primary substrate, the top face of which is partly comprised of the top face of the tabstock and partly comprised of the foam layer of the seal laminate prior to reaching the laminating station;

(c) feeding a plastics material film stock which has a top and bottom surface to the laminating station; and (d) continuously extruding a polymeric adhesive between the top face of the primary substrate and the bottom surface of the plastic film stock;

(e) applying a molten wax layer to the top surface of the plastic material film stock; and (f) adhering an absorbent liner to the wax layer while it is still molten.

In step (b), in a further embodiment of the present invention, the feed may comprise a plurality of narrow tabstocks arranged at regularly spaced apart intervals. In this way, a wide sheet of seal laminate including a tabstock may be formed which can then be cut to size.

Prior to reaching the laminating station, the bottom face of the tabstock and the top face of the foam layer of the seal laminate are brought into contact. At this stage there is no adhesion between the two feeds. The two feeds are fed in contact with each other to the laminating station. In order to achieve this, the two feeds must approach the laminating station from the same side.

Preferably the polymeric adhesive which is continuously extruded is selected from polyethylene or polyethylene acrylate. Most preferably the polymeric adhesive has a melt flow index in the range from 2 to 17 dg/min. Preferably the coat weight of the adhesive is in the range from 15 to 50 $gm^{-2}$.

In step (d), preferably the top face of the primary substrate and the bottom surface of the plastic film shock are adhered together with a bond strength greater than 15N/12.5 mm at 330 mm/min when the tabstock is pulled at 90° to the machine direction and 180° to the primary substrate.

The top layer of the seal substrate is a plastics material layer. Preferably the plastics material is polyester or polyamide, most preferably polyester. In a particularly preferred embodiment, the polyester layer is polyethylene terephthalate. The polyester layer may be a surface treated polyethylene terephthalate such as, for example, Lumirror 10.47™. This polyester layer preferably has a thickness in the range from 15 to 40 μm. The top plastic material layer of the seal substrate forms the top layer of the seal laminate of the vessel closing laminate. The seal is adhered to the liner by means of a wax layer on top of the plastics material layer. Preferably the wax is food grade wax. The wax may be applied in either a dot or hatch pattern and is applied with a coat weight in the range from 5 to 20 $gm^{-2}$. The adhesion between the wax layer and the absorbent liner is of a temporary nature. This means that the seal and liner will remain adhered together in the final laminate during subsequent processing steps including cutting and fitting into the cap of a container. However, in use in the final sealed container with a cap, the adhesion is no longer present because the wax has been absorbed by the liner as a result of the heat from the induction heating step. The wax layer serves to adhere the seal and liner together sufficiently strongly that they will remain adhered during processing operations. Preferably the wax layer binds the top plastics material layer of the seal substrate to the liner with a strength such that the peel strength is, after manufacture and before induction heat sealing of the seal to a container to be sealed greater than 3N as measured at a rate of 500 mm/min on a sample strip 50 mm wide. The sample is tested at 90° using a roller jig as based on the Floating Roller Method, ASTM method 1464:1995.

The peel strength after manufacture and before induction heat sealing was also measured to be greater than 180 g as measured at a rate of 1500 mm/min on a sample strip 25 mm wide. The sample is tested at 90°.

In use, the vessel closing laminate is cut to size to form a vessel closing assembly. The vessel closing assembly is inserted into a cap which, in turn, is applied to the neck of a container to be sealed. Heat is then applied to seal the bottom subassembly of layers to the neck of the container. The heat applied causes the wax layer to melt. The molten wax is absorbed by the liner layer and, as such, at this stage of processing is no longer present as a separate adhesive layer. Thus at this point, the seal and liner are no longer adhered to one another. The vessel closing assembly can thus be adhered to the screw cap without any concern of ripping the seal upon opening because the bond between the seal and liner is no longer present. Thus on opening, the vessel closing assembly will simply separate between the top polyester layer and the absorbent liner without requiring significant force. The absorbent liner which has absorbed the wax layer will remain in the cap and the seal will remain adhered to the neck of the container.

The absorbent liner may be formed of a layer of food grade cardboard or pulpboard. In an alternative embodiment, the liner may be formed from a synthetic material such as a layer of foamed plastic material to which a paper layer has been adhered to the bottom surface. Where a synthetic liner is used, the paper layer as a bottom layer is required as the layer in contact with the wax layer which needs to be able to absorb the molten wax. The liner preferably has a thickness in the range from 400 to 1500 μm.

The vessel closing laminate of the present invention may be cut into disks to form a vessel closing assembly and may be adhered within a screw cap. The screw cap may generally be a conventional one. Once the vessel closing assembly has been adhered within a screw cap, the screw cap may be screwed on to the open neck of a container thus sandwiching the vessel closing assembly between the open neck of the container and the top of the cap. The vessel closing assembly is then adhered to the open neck of the container by applying heat either by induction heating or conduction heating.

BRIEF DESCRIPTION OF THE DRAWINGS

An embodiment of the present invention will now be described with reference to the following figures in which.

DETAILED DESCRIPTION

Figure 1:
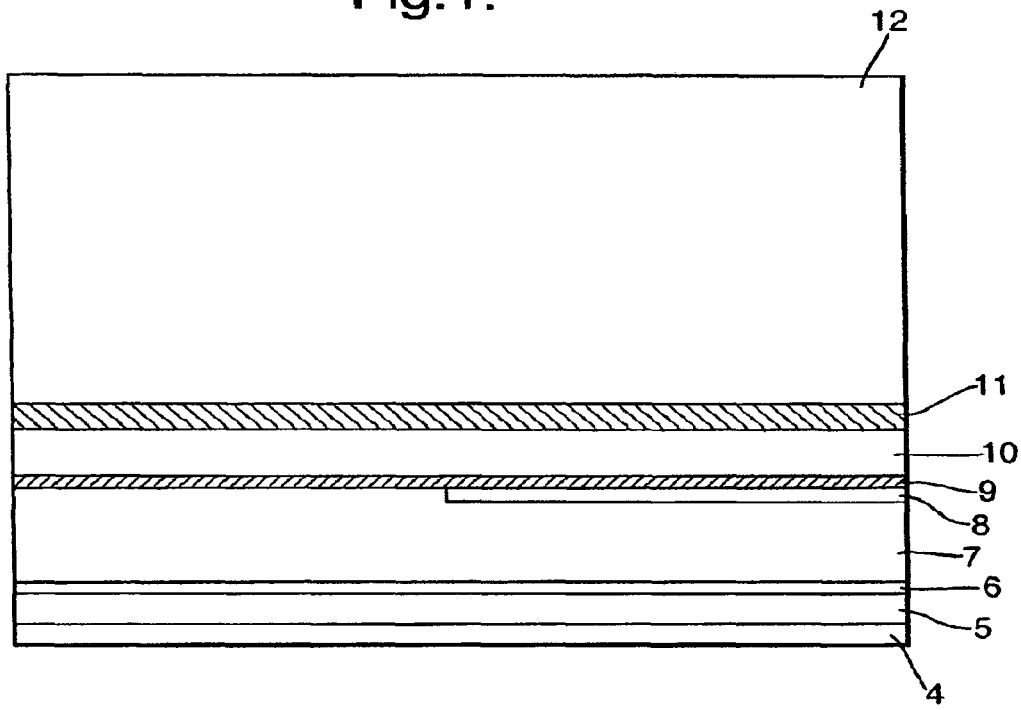
FIG. 1 is a cross-section though an example of a vessel closing assembly according to the present invention with a vertical dimension greatly exaggerated.
Figure 2:
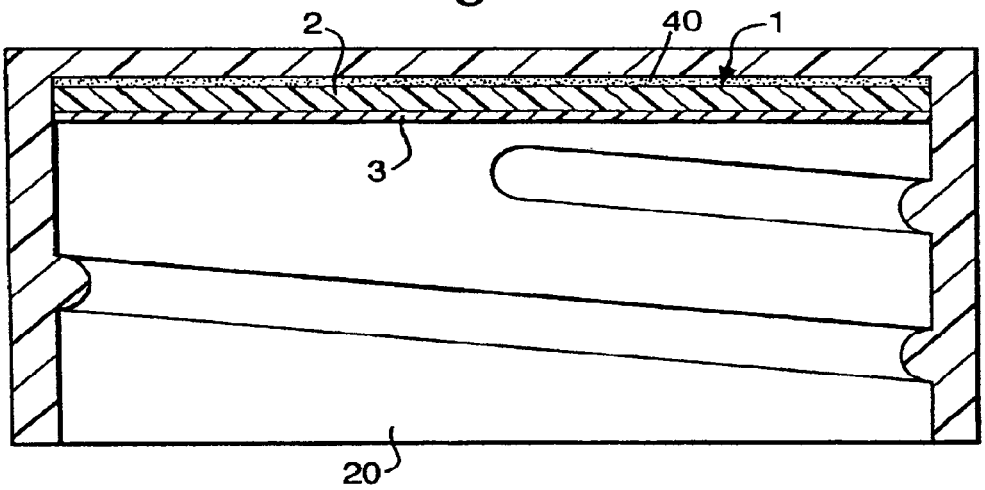
FIG. 2 is a cross-section through a screw cap showing the vessel closing assembly in place.

The vessel closing laminate (1) comprises a liner portion (2) and a seal laminate (3) attached together. The vessel closing laminate 1 is formed by a laminate of a number of layers which, starting from the bottom comprise a coating of hot melt adhesive (4) deposited typically at a rate of in the range 12 to 60 $g/m^2$ and may include polyester coatings, polyethylene, ethylene vinyl acetate, polypropylene, ethylene-acrylic acid co-polymers, or Surlyn™; a layer of aluminum foil (5) which is 20 μm thick; a layer of polymeric adhesive (6) applied, for instance at a rate in the range of 3 $g/m^2$ to 20 $g/m^2$; a layer of polyethylene foam (7) 125 μm thick; a layer of polyethylene terephthalate (8) which has been printed extending only part way across the layer of foam (7) and not adhered to the layer of foam (7); a layer of polymeric adhesive (9) applied, for instance at a rate of 20 to 50 g/m$^2$; a layer of surface treated polyethylene terephthalate (10) 36 μm thick which is adhered both to the foam (7) and the polyethylene terephthalate layer (8); a layer of wax (11) applied in a dot pattern with a coat weight of 4 to 18 gm$^{-2}$ and, a layer (12) of food grade cardboard which is approximately 900 μm thick.

The adhesive layers (6 and 9) are typically polyurethane or polyethylene acrylate. As described previously, in one embodiment, the adhesive layer (9) may be extruded between the layer of polyethylene terephthalate (8) and the layer of polyethylene terepthalate (10).

In such an embodiment a seal laminate comprising heat sealable layers (4) for adhesion to a container to be sealed, a foil layer (5) and a top layer of polyethylene foam (7) is obtained commercially from Isco Jacques Schindler AG. As an alternative to purchasing this part of the structure, it may be formed by lamination as described above. This seal laminate is rolled onto a first feed roll (13) in the laminating apparatus.

The second feed roll (14) in the laminating apparatus is the source of the tabstock, which in this case, is a layer of polyethylene terephthalate (8). The width of the layer of polyethylene terephthalate (8) is in the range from 25-60 mm.

A third feed roll (15) is loaded with a PET stock (10) which can be obtained commercially from Toray, Europe. The thickness of the PET stock (10) is in the range from 23-36 μm. The PET stock (10) used is a co-extruded PET heat seal layer in order to ensure optimal adhesion.

The seal laminate (3*a*), tabstock (8) and PET stock (10) are simultaneously fed to the laminating station (6) where an extruder (17) is positioned vertically above the point of contact between the feeds. Prior to reaching the laminating station (16), the seal laminate (3*a*) and tabstock (8) are brought into contact to form a primary substrate (1*a*).

Figure 4:
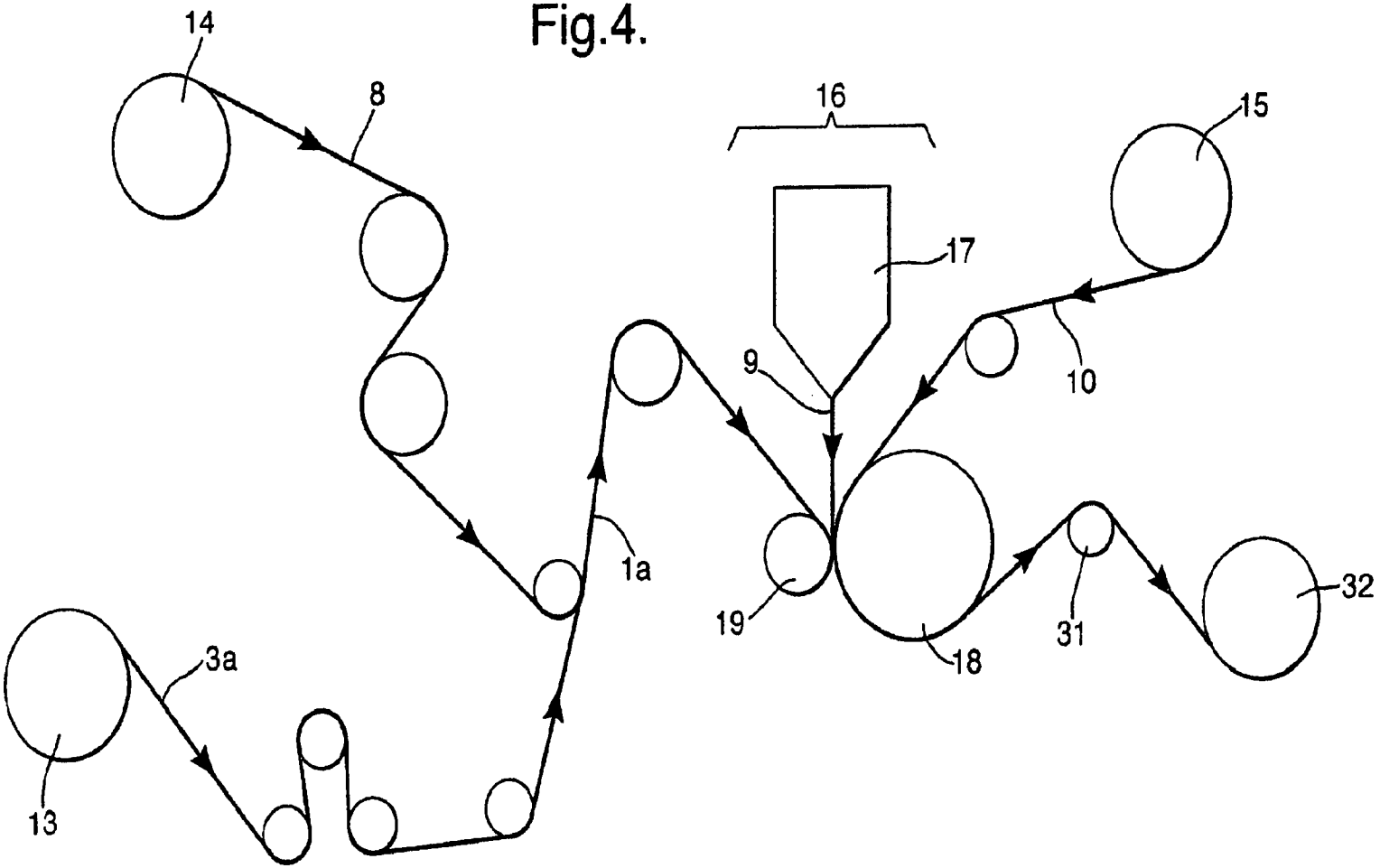
FIG. 4 is a schematic representation of a process by which the seal laminate may be formed.

Polyethylene acrylate (9) is then extruded continuously as a curtain from the extruder (17) between the top face of the primary laminate (1*a*) and the bottom face of the PET stock (10). The extrusion conditions were such that a temperature of approximately 230° C. was attained at the nip. The rollers (18) and (19) are moving at a speed of 70 m/min relative to the speed of application of the adhesive. the bottom face of the PET stock (10) and the resulting primary laminate including a tabstock is passed via a chill roller (31) to be rolled on to a final product roll (32). This process is illustrated schematically in FIG. 4.

Figure 3:
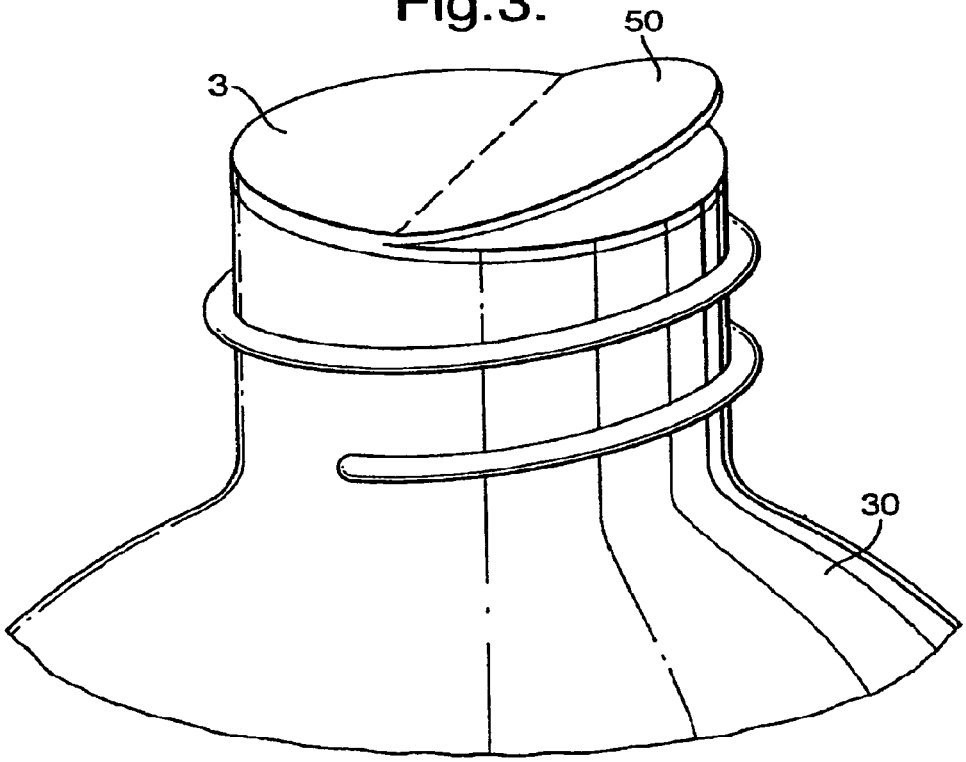
FIG. 3 is a perspective view showing the seal in place on the neck of a container.

As a result of the presence of the wax layer (11), a bond is formed between the seal portion (3) and the liner portion (2). The peel strength after manufacture and before induction heat sealing to a container to be sealed of the absorbent liner from the top polyester layer of the seal is measured to be greater than 3N at 500 μm/min on a 50 mm wide sample at 90° using a roller jig based on ASTM method 1464:1995, the Floating Roller method. This bond holds the two portions (2 and 3) together during subsequent processing and handling. The presence of the polyethylene terephthalate partial layer (8) and the fact that it is not bonded to the foam layer (7) provides a separate tab portion formed by the layers (8 and 10) which is not adhered to the layer (7) and so forms a liftable tab (50) (shown in FIG. 3) which will be described subsequently.

After formation of the laminate it is die cut to form individual discs of vessel closing assembly (1). The one-component liner (1) is press-fitted inside the top of a screw cap (20) and adhered in place by means of a hot melt adhesive. In use, a screw cap equipped with a vessel closing assembly (1) in accordance with the present invention is screwed onto the open neck of a bottle (30) so sandwiching the vessel closing assembly (1) between the open neck of the bottle (30) and the top of the cap (20). The cap (20) and bottle (30) are then subjected to an induction heating step in which the aluminum foil (5) is heated around its periphery by the generation of eddy currents within it which, in turn, melts the coating (40) of hot melt adhesive to bond the seal portion (3) onto the open neck of the bottle (30). This has the effect of melting the wax layer (11). The molten wax is absorbed by the liner (12). The sealed container is then distributed.

When the screw cap (20) is removed from the bottle (30) by the eventual user the seal portion (3) remains adhered to the open neck of the bottle (30) whilst the liner portion (1) is retained in the cap. The seal portion (3) and liner portion (2) part between the top polyethylene terephthalate layer (10), and layer of food grade cardboard (12) during this initial removal of the cap (20) from the neck of the bottle (30). The eventual consumer can then easily remove the seal portion (3) from the neck of the bottle (30) merely by gripping the tab portion (50) formed by the layers (8) and (10) with the manual force applied to the tab (50) overcoming the adhesion provided between the hot melt coating (4) and the neck of the bottle (30) to enable the entire seal portion (3) to be removed to allow the eventual user to gain access to the contents of the bottle (30). The liner portion (2) remains adhered within the cap to form a secondary seal when the bottle is reclosed by the cap.

The invention claimed is:

1. A vessel closing laminate comprising:

a seal laminate comprising a bottom subassembly of layers including a foil layer; and a seal substrate attached to the uppermost layer of the bottom subassembly of layers wherein the seal substrate has a bottom foam layer and a top plastics material layer and further includes a free tab lying wholly within the circumference of the seal laminate;

a wax layer on top of the top plastics material layer of the seal substrate; and an absorbent liner adhered to the top plastics material layer of the seal substrate by the wax layer.

2. The laminate according to claim 1, wherein the absorbent liner is formed from cardboard or pulpboard.

3. The laminate according to claim 2, wherein the top plastics material layer of the seal substrate is a polyester.

4. The laminate according to claim 3 wherein the polyester is polyethylene terephthalate.

5. The laminate according to claim 1, wherein one or more bottom food contact layers are induction heat sealable.

6. The laminate according to claim 1, wherein the wax layer has a dot or hatch patterning.

7. The laminate according to claim 6, wherein the wax layer is adhered to the top plastic material layer of the seal substrate with a peel strength of greater than 3N as measured at a rate of 500 mm/min on a sample strip 50 mm wide in accordance with ASTM 1464:1995.

8. The laminate according to claim 1, wherein the wax layer has a coat weight in the range from 4 to 18 gm$^{-2}$.

9. The laminate according to claim 1 wherein the free tab is formed by the top plastic material layer being adhered to the bottom foam layer of the seal substrate over only a portion of the diameter of the seal.

10. The laminate according to claim 9, wherein a further layer of polyethylene terephthalate, nylon or polypropylene is interposed between the top plastics material layer and the bottom foam layer of the seal substrate in the region where they are not bonded together.

11. The vessel closing laminate of claim 1, wherein the bottom foam layer is a foamed polyolefin about 70 to about 300 microns thick, the wax layer is about 4 to about 18 g/m$^2$, and the foil layer is about 12 to about 30 microns thick so that the foil layer is effective to melt the wax layer across the entire surface of top plastics material layer to permit separation of the absorbent liner from the top plastics material layer when heat sealing the vessel closing laminate to a container.

12. The vessel closing laminate of claim 11, wherein the wax layer has a dot or hatch patterning and where the wax layer is adhered to the top plastic material layer of the seal substrate prior to heat sealing the vessel closing laminate to a container with a peel strength of greater than 3N as measured at a rate of 500 mm/min on a sample strip 50 mm wide in accordance with ASTM 1464:1995.

13. The vessel closing laminate of claim 5, wherein the bottom food contact layers are heat sealable and the free tab is formed by the top plastics material layer being adhered to the bottom foam layer of the seal substrate over only a portion of the diameter of the seal.

14. The vessel closing laminate of claim 13, wherein a further layer is interposed between the top plastics material layer and the bottom foam layer of the seal substrate in the region where they are not bonded together.

15. The vessel closing laminate of claim 13, wherein the foil layer and the seal substrate permit melting of the wax layer so that the absorbent liner separates from the top plastics material layer when heat sealing the vessel closing laminate to a container.

16. A screw cap including the vessel closing laminate according to claim 1 which has been cut to form a vessel closing assembly.

17. The screw cap according to claim 16 wherein the vessel closing assembly is adhered within the cap.

18. The screw cap according to claim 17, wherein the vessel closing assembly is fixed in position in the cap.

19. A container fitted with a cap according to claim 16 wherein the bottom subassembly of layers of the vessel closing assembly are sealed to the mouth of the container and the wax layer has been absorbed by the absorbent liner.

20. A method of forming the vessel closing laminate according to claim 1 comprising the steps of:

(a) feeding the seal laminate comprising the bottom subassembly of layers and the bottom foam layer of the seal substrate to a laminating station;

(b) feeding a tabstock which is narrower than the seal laminate to the laminating station such that the bottom of the tabstock and the top of the bottom foam layer of the seal laminate come into contact to form a primary substrate, the top face of which is partly comprised of the top face of the tabstock and partly comprised of the bottom foam layer of the seal laminate prior to reaching the laminating station;

(c) feeding the top plastics material layer which has a top and bottom surface to the laminating station;

(d) continuously extruding a polymeric adhesive between the top face of the primary substrate and the bottom surface of the top plastics material layer;

(e) applying the molten wax layer to the top surface of the top plastics material layer; and (f) adhering the absorbent liner to the wax layer while it is still molten.

21. The method according to claim 20, wherein in step (d), the top face of the primary substrate and the bottom surface of the plastic film stock are adhered together with a bond strength greater than 15N/12.5 mm at 330 mm/min when the tabstock is pulled at 90° to the machine direction and 180° to the primary substrate.

22. The method according to claim 20, wherein in step (e), the molten wax layer is applied to obtain a coat weight in the range from 4 to 18 gm$^{-2}$.

23. The method according to claim 20 wherein the polymeric adhesive has a melt flow index in the range from 2 to 17 dg/min.

24. The method according to claim 20, wherein the polymeric adhesive is ethylene acrylate.

25. The method according to claim 20 wherein in step (e), the molten wax layer is applied in a dot or hatched pattern.

* * * * *